US006659634B2

(12) United States Patent
Hiraoka et al.

(10) Patent No.: US 6,659,634 B2
(45) Date of Patent: Dec. 9, 2003

(54) CHEMICAL SOLUTION FEEDING APPARATUS AND METHOD FOR PREPARING SLURRY

(75) Inventors: Naoki Hiraoka, Kasugai (JP); Hiroshi Osuda, Kasugai (JP); Hotaka Yamamoto, Kasugai (JP)

(73) Assignee: Fujitsu VLSI Limited, Kasugai (JP)

( * ) Notice: Subject to any disclaimer, the term of this patent is extended or adjusted under 35 U.S.C. 154(b) by 0 days.

(21) Appl. No.: 10/282,116

(22) Filed: Oct. 29, 2002

(65) Prior Publication Data

US 2003/0104959 A1 Jun. 5, 2003

(30) Foreign Application Priority Data

Dec. 5, 2001 (JP) ..... 2001-371944

(51) Int. Cl.[7] ..... E03B 1/00; F17D 1/00

(52) U.S. Cl. ..... 366/151.1; 366/160.1; 137/3; 137/4

(58) Field of Search ..... 366/101, 130, 366/131, 132, 48, 172.2, 168, 151.1, 160.1; 422/133; 137/3, 4

(56) References Cited

U.S. PATENT DOCUMENTS 4,994,212 A * 2/1991 Vos et al. ..... 264/3.3
5,332,589 A * 7/1994 Hinnergardt et al. ..... 426/231
5,409,310 A * 4/1995 Owczarz ..... 366/136

FOREIGN PATENT DOCUMENTS

JP 11-126764 5/1999

* cited by examiner

*Primary Examiner*—Gregory E. Webb
(74) *Attorney, Agent, or Firm*—Armstrong, Westerman & Hattori, LLP

(57) ABSTRACT

An apparatus for feeding slurry to an external device. The apparatus includes a preparation tank for preparing the slurry. A circulation pipe is connected to the preparation tank to circulate the slurry. A feeding pipe is connected between the preparation tank and the external device to feed the external device with the slurry. A pump sends the chemical solution in the preparation tank to the circulation pipe and the feeding pipe. A concentration detector is arranged downstream to the pump to detect the concentration of the slurry. A controller controls the concentration of the chemical solution in the preparation tank in accordance with the detection value of the concentration detector and controls the feeding of the chemical solution.

10 Claims, 7 Drawing Sheets

CHEMICAL SOLUTION FEEDING APPARATUS AND METHOD FOR PREPARING SLURRY

BACKGROUND OF THE INVENTION

The present invention relates to an apparatus for feeding slurry to a chemical mechanical polishing (CMP) apparatus during a semiconductor fabrication process and a method for preparing slurry.

During a semiconductor fabrication process, a CMP device polishes a film, which is applied to a wafer surface and formed from metal such as tungsten or copper, with a chemical solution that includes a polishing agent. The chemical solution is a slurry that is prepared by mixing a polishing agent and an oxidizing agent in a stock solution. To fabricate semiconductor devices with uniform circuit wiring dimensions and increase yield, the concentration of the oxidizing agent in the slurry must be maintained at a constant value.

In the prior art, the polishing agent is formed from abrasive grains, such as silica, alumina, or cerium, and the oxidizing agent is formed from ferric nitrate. The pH of a mixture of the polishing agent and the stock solution (slurry stock solution) differs greatly from the pH of the oxidizing agent. The mixing ratio of the slurry stock solution and the oxidizing agent (slurry stock solution: oxidizing agent) is 1:1 or 2:1. The concentration of the oxidizing agent in the slurry may be obtained by measuring the pH after the slurry stock solution and the oxidizing agent is mixed.

However, chemical reaction between the polishing agent and the oxidizing agent tends to coagulate the abrasive grains. The abrasive grains precipitates within a short period especially when alumina is used as the abrasive grains. This results in an instable polishing rate and scratches the polishing surface with the coagulated abrasive grains. Therefore, aqueous hydrogen peroxide ($H_2O_2$) is nowadays used as the oxidizing agent.

The pH of the aqueous hydrogen peroxide is about 7.0 and neutral, and the mixing ratio of the slurry stock solution and the oxidizing agent is 10:1 or greater. Thus, the pH of the mixture does not change much when the oxidizing agent is added to the slurry stock solution. As a result, the concentration of the oxidizing agent cannot be obtained from the pH.

To measure the concentration of the aqueous hydrogen peroxide in the slurry, the incorporation of an automatic titration device in a chemical solution feeding apparatus has been proposed. However, titration analysis requires at least about ten minutes to perform a single analysis. Therefore, the concentration of the mixture cannot be constantly monitored even when using the automatic titration device.

Further, a reagent is used to conduct the titration analysis. The reagent must be replenished when it becomes insufficient. The adding interval becomes shorter when the titration analysis interval is shortened. This causes the replenishment of the reagent to be burdensome. Further, a drainage process must be performed to purify the waste liquid produced by the titration analysis.

The aqueous hydrogen peroxide dissolves in the slurry. Thus, as shown in FIG. 9, the concentration C of the aqueous hydrogen peroxide in the slurry decreases as time elapses. To maintain the concentration of the oxidizing agent at a constant value, the concentration of the aqueous hydrogen peroxide must be measured in order to replenish the aqueous hydrogen peroxide when it becomes insufficient.

The automatic titration analysis is optimal for performing concentration detection to replenish insufficient aqueous hydrogen peroxide. However, when detection results must be obtained immediately to constantly check the concentration of the oxidizing agent, the automatic titration apparatus should not be employed.

The concentration of the stock solution of the aqueous hydrogen peroxide is not constant since the aqueous hydrogen peroxide vaporizes. Accordingly, even if the slurry stock solution and the aqueous hydrogen peroxide are mixed at a predetermined mixing ratio, the concentration of the aqueous hydrogen peroxide in the slurry does not remain constant and may thus exceed a predetermined concentration.

In this case, the slurry stock solution must be replenished again. Then, the aqueous hydrogen peroxide must be replenished, and the concentration of the aqueous hydrogen peroxide must be adjusted. This is burdensome.

Further, after preparing slurry having a predetermined concentration, the aqueous hydrogen peroxide reacts with the slurry as time elapses and deteriorates the slurry components. This fluctuates the polishing rate.

Japanese Laid-Open Patent Publication No. 11-126764 describes a slurry feeding apparatus having two tanks to constantly feed fresh slurry to a polishing machine. In each tank of the double-tank slurry feeding apparatus, the preparation of the slurry and the feeding of the prepared slurry until the slurry is emptied are performed alternately. Accordingly, unless the concentration of the aqueous hydrogen peroxide is accurately adjusted when the slurry is prepared, the concentration of the aqueous hydrogen peroxide may differ between batches.

SUMMARY OF THE INVENTION

It is an object of the present invention to provide an apparatus that prepares a mixed chemical solution maintained at a desired concentration.

To achieve the above object, the present invention is an apparatus for feeding a chemical solution to an external device. The apparatus includes a preparation tank supplied with a first stock solution and a second stock solution to mix the first and second stock solutions and prepare the chemical solution. A circulation pipe is connected to the preparation tank to circulate the chemical solution that is being prepared. A feeding pipe is connected between the preparation tank and the external device to feed the external device with the chemical solution contained in the preparation tank. A pump sends the chemical solution in the preparation tank to the circulation pipe and the feeding pipe. A concentration detector is arranged downstream to the pump to detect the concentration of the chemical solution. A controller controls the concentration of the chemical solution in the preparation tank in accordance with a detection value of the concentration detector and controls the feeding of the chemical solution.

A further perspective of the present invention is a method for preparing slurry. The method includes preparing slurry by mixing a slurry stock solution and an oxidizing agent, the oxidizing agent being mixed so that the concentration of the oxidizing agent in the slurry is less than a predetermined target value, detecting the concentration of the oxidizing agent in the slurry, and additionally supplying the oxidizing agent so that the concentration of the oxidizing agent becomes equal to the predetermined value.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
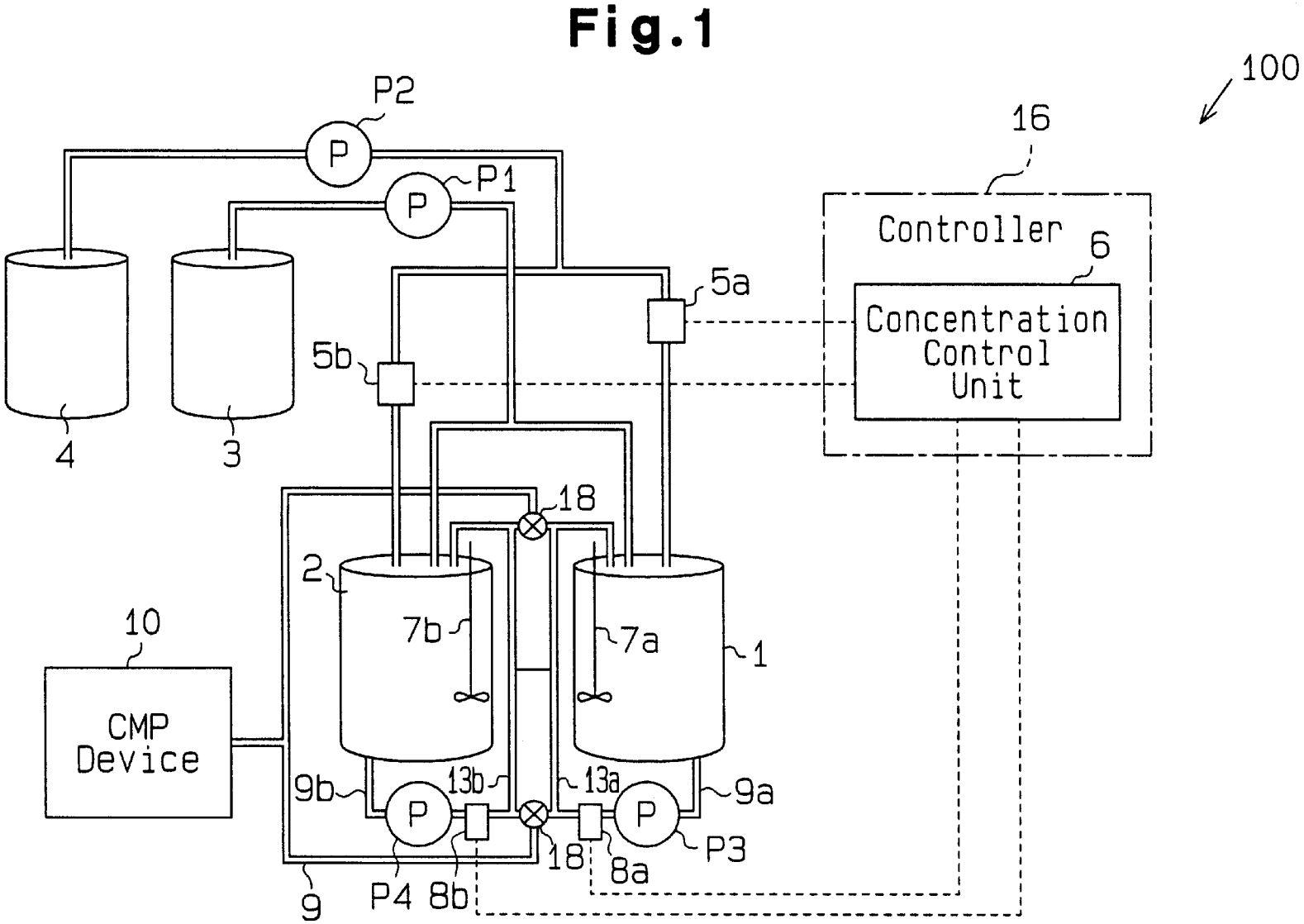
FIG. 1 is a schematic diagram showing a chemical solution feeding apparatus according to a first embodiment of the present invention.

FIG. 1 is a schematic diagram of a chemical solution feeding apparatus 100 according to a first embodiment of the present invention. The slurry feeding apparatus 100 includes a first preparation tank 1 and a second preparation tank 2. When slurry is fed from one of the tanks 1, 2, slurry is prepared in the other one of the tanks 1, 2. This continuously feeds a CMP device 10 with fresh slurry.

Slurry stock solution is contained in a first stock solution tank 3. The slurry stock solution is sent to the first and second preparation tanks 1, 2 via a first stock solution pump P1. Aqueous hydrogen peroxide, which is an oxidizing agent, is contained in a second stock solution tank 4. The aqueous hydrogen peroxide is sent to the first preparation tank 1 via a second stock solution pump P2 and a stock solution valve 5*a* and sent to the second preparation tank 2 via the second stock solution pump P2 and a stock solution valve 5*b*.

A controller 16, which controls the slurry feeding apparatus 100, includes a concentration control unit 6. The concentration control unit 6 provides the stock solution valves 5*a*, 5*b* with a control signal to change the flow and flow rate of the aqueous hydrogen peroxide.

Agitators 7*a*, 7*b*, which are respectively arranged in the first and second preparation tanks 1, 2, agitate the slurry stock solution and the aqueous hydrogen peroxide.

A first feeding pipe 9*a* and a second feeding pipe 9*b* are connected to the lower portions of the first and second preparation tanks 1, 2, respectively. The first feeding pipe 9*a* includes a slurry pump P3 and a first concentration detector 8*a*, which is arranged downstream to the slurry pump P3. A first circulation pipe 13*a* extends from the first feeding pipe 9*a* downstream of the first concentration detector 8*a* and connects with the upper portion of the first preparation tank 1. The second feeding pipe 9*b* includes a slurry pump P4 and a second concentration detector 8*b*, which is arranged downstream to the slurry pump P4. A second circulation pipe 13*b* extends from the second feeding pipe 9*b* downstream of the second concentration detector 8*b* and connects with the upper portion of the second preparation tank 2.

When slurry is being prepared in the first preparation tank 1, switch valves 18 are operated so that the first preparation tank 1 is connected to the first circulation pipe 13*a* via the slurry pump P3 and the first concentration detector 8*a*. In this case, the slurry pump P3 sends the slurry that is being prepared in the first preparation tank 1 through the first circulation pipe 13*a* and returns the slurry to the first preparation tank 1. The circulation of the slurry effectively agitates the slurry in the first preparation tank 1.

When slurry is being prepared in the second preparation tank 2, the switch valves 18 are operated so that the second preparation tank 2 is connected to the second circulation pipe 13*b* via the slurry pump P4 and the second concentration detector 8*b*. In this case, the slurry pump P4 sends the slurry that is being prepared in the second preparation tank 2 through the second circulation pipe 13*b* and returns the slurry to the second preparation tank 2. The circulation of the slurry effectively agitates the slurry in the second preparation tank 2.

The first concentration detector 8*a* is located between the slurry pump P3 and the first circulation pipe 13*a*. The second concentration detector 8*b* is located between the slurry pump P4 and the second circulation pipe 13*b*. The concentration detectors 8*a*, 8*b* each detect the concentration of the aqueous hydrogen peroxide in the slurry that is sent to the associated circulation pipes 13*a*, 13*b* from the preparation tanks 1, 2. Then, the concentration detectors 8*a*, 8*b* each provide the concentration control unit 6 with a detection signal indicating the detected concentration of the aqueous hydrogen peroxide.

When feeding the slurry in the first preparation tank 1 to the CMP device 10, the switch valves 18 are switched to connect the first preparation tank 1 to a main pipe 9. The slurry pump P3 sends the slurry through the first concentration detector 8*a* and the main pipe 9 and feeds the slurry to the CMP device 10.

When feeding the slurry in the second preparation tank 2 to the CMP device 10, the switch valves 18 are switched to connect the second preparation tank 2 to the main pipe 9. The slurry pump P4 sends the slurry through the second concentration detector 8*b* and the main pipe 9 and feeds the slurry to the CMP device 10.

The concentration detectors 8*a*, 8*b* each provide the concentration control unit 6 with a detection signal indicating the concentration of the aqueous hydrogen peroxide in the slurry that is fed to the CMP device 10 from the associated preparation tanks 1, 2.

Figure 2:
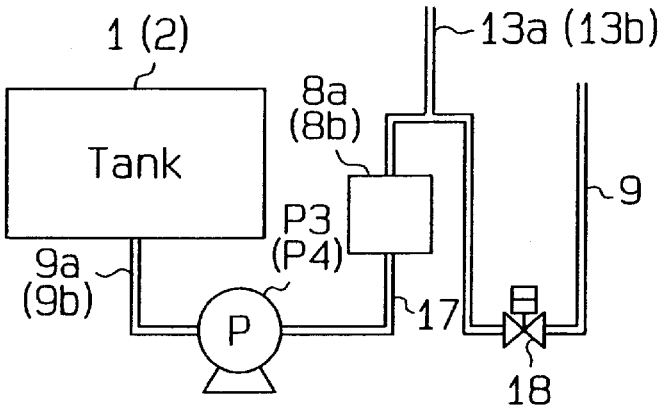
FIG. 2 is a schematic diagram showing the position of a concentration detector.

FIG. 2 indicates the location of the first concentration detector 8*a*. The first concentration detector 8*a* is arranged downstream to the slurry pump P3 in a vertically extending pipe 17. The slurry discharged from the slurry pump P3 is drawn into the lower portion of the first concentration detector 8*a*, moved upward through the first concentration detector 8*a*, and sent out of the upper portion of the first concentration detector 8*a*. The slurry passing through the first concentration detector 8*a* further flows through the switch valve 18 and the main pipe 9 and is fed to the CMP device 10.

Figure 3:
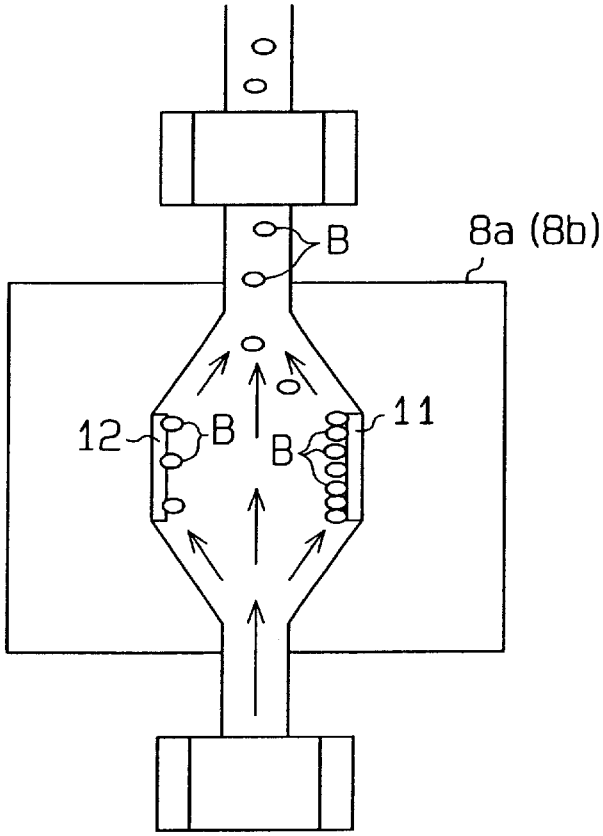
FIG. 3 is a schematic diagram showing the concentration detector.

Referring to FIG. 3, it is preferred that an ultrasonic detector be used as the concentration detector 8*a* (or 8*b*). The first concentration detector 8*a* includes a detection portion 11 and a reflection portion 12, which is opposed to the detection portion 11. The detection portion 11 generates ultrasonic waves directed toward the reflection portion 12. The first concentration detector 8*a* measures the time required for the ultrasonic waves to return to the detection portion 11 and calculates the transmission speed of the ultrasonic waves (sonic velocity) in the slurry. The first concentration detector 8*a* calculates the concentration of the aqueous hydrogen peroxide from the transmission speed.

The slurry moves upward through the first concentration detector 8*a*. When bubbles B, which are included in the slurry, approach the detection portion 11 and the reflection portion 12, the slurry discharged from the slurry pump P3 forces the bubbles B upward. Thus, the bubbles B do not collect at the detection portion 11 and the reflection portion 12. The structure of the second concentration detector 8*b* is the same as that of the first concentration detector 8*a*.

The concentration control unit 6 controls the stock solution valves 5*a*, 5*b* in accordance with the detection signals of the concentration detectors 8*a*, 8*b* so that the concentration of the aqueous hydrogen peroxide in the slurry is maintained at a predetermined target value in the preparation tanks 1, 2.

A liquid amount sensor (not shown) is arranged in each of the first and second preparation tanks 1, 2 to detect the surface level of the slurry. The liquid amount sensor provides a detection signal to the controller 16.

The controller 16 controls the stock solution pumps P1, P2, which respectively supply the slurry stock solution and the aqueous hydrogen peroxide to the associated preparation tanks 1, 2, and the slurry pumps P3, P4, which discharge the slurry from the preparation tanks 1, 2. The controller 16 refers to the rotated amount of a shaft driving each solution pump P1, P2 to determine the flow rate of the slurry stock solution or the aqueous hydrogen peroxide.

The operation of the slurry feeding apparatus 100 will now be discussed.

In the first and second preparation tanks 1, 2, the preparation of the slurry and the feeding of the slurry to the CMP device 10 are performed alternately. When one of the first and second preparation tanks 1, 2 prepares the slurry, the other one of the tanks 1, 2 feeds the slurry to the CMP device 10. For example, to prepare slurry in the first preparation tank 1, the agitator 7*a* agitates the slurry stock solution from the first stock solution tank 3 and the aqueous hydrogen peroxide from the second stock solution tank 4.

The slurry pump P3 forces the slurry from the first preparation tank 1 through the first circulation pipe 13*a* and returns the slurry to the upper portion of the first preparation tank 1 in which the slurry is agitated. The first concentration detector 8*a* constantly, or continuously, detects the concentration of the aqueous hydrogen peroxide in the circulating slurry. The concentration control unit 6 controls the stock solution valve 5*a* in accordance with the detection signal of the first concentration detector 8*a* to adjust the flow rate of the aqueous hydrogen peroxide. This maintains the aqueous hydrogen peroxide concentration of the slurry at the target value.

In this state, the second preparation tank 2 feeds slurry to the CMP device 10. That is, the slurry pump P4 forces the slurry in the second preparation tank 2 through the second concentration detector 8*b* and the main pipe 9 and feeds the slurry to the CMP device 10. The second concentration detector 8*b* constantly, or continuously, detects the concentration of the aqueous hydrogen peroxide in the circulating slurry. The concentration control unit 6 controls the stock solution valve 5*b* in accordance with the detection signal of the second concentration detector 8*b* to adjust the concentration of the aqueous hydrogen peroxide in the fed slurry.

Figure 4:
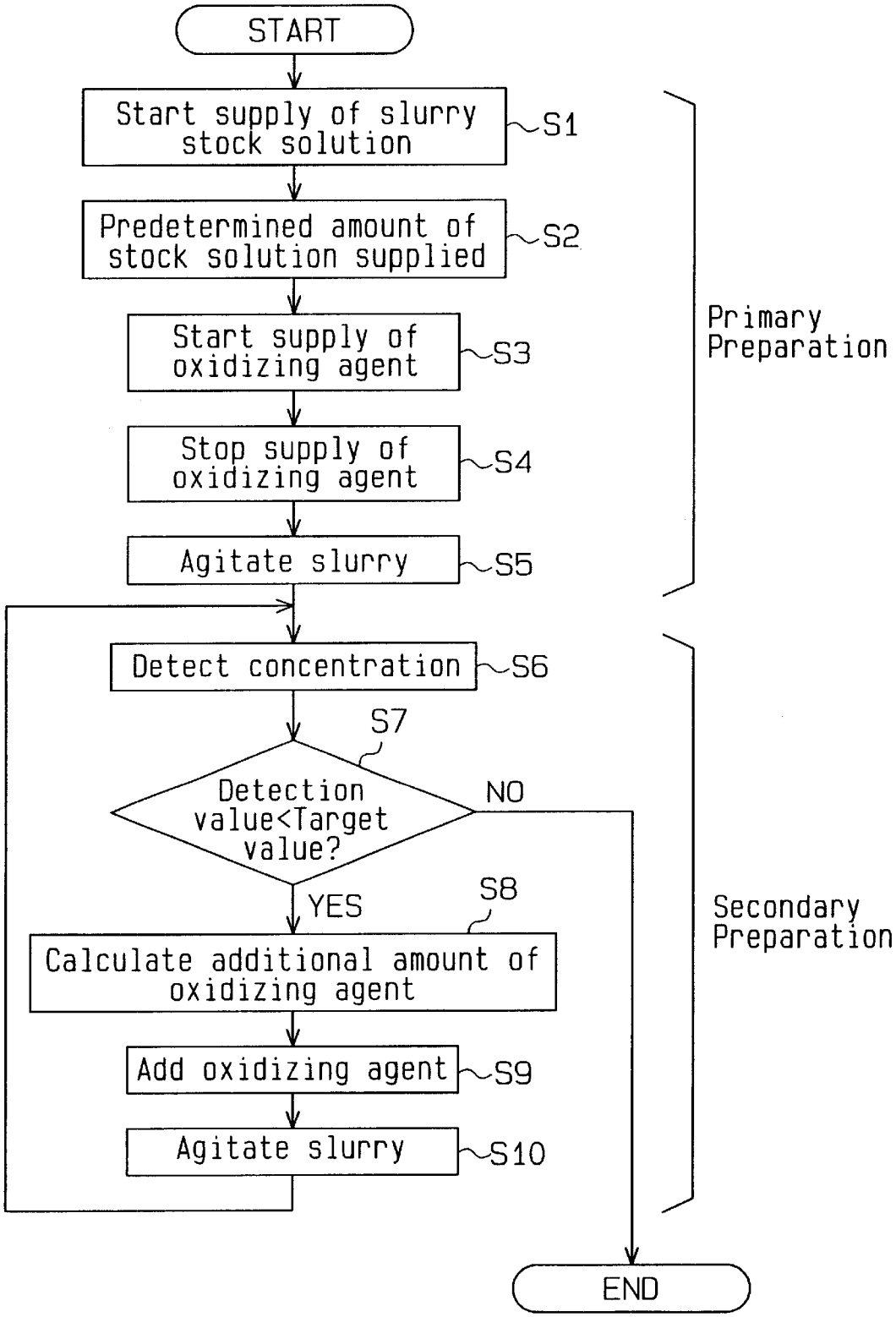
FIG. 4 is a flowchart illustrating the operation of a concentration control unit.

A process performed by the controller 16 and the control unit 6 will now be discussed with reference to FIG. 4.

To prepare slurry in, for example, the first preparation tank 1, at step S1, the controller 16 activates the first stock solution pump P1 to start supplying send slurry stock solution from the first stock solution tank 3 to the first preparation tank 1.

At step S2, when the amount of slurry stock solution supplied to the first stock solution tank 3 reaches a predetermined amount, the controller 16 de-activates the first stock solution pump P1. Then, at step S3, the controller 16 activates the second stock solution pump P2 to open the stock solution valve 5*a* and supply aqueous hydrogen peroxide to the first preparation tank 1 from the second stock solution tank 4.

At step S4, after a predetermined amount of the aqueous hydrogen peroxide is supplied to the first preparation tank 1, the controller 16 de-activates the second stock solution pimp P2 and closes the stock solution valve 5*a*. The amount of the aqueous hydrogen peroxide sent to the first preparation tank 1 is less than the amount required for the aqueous hydrogen peroxide to match the target concentration value.

At step S5, the controller 16 activates the agitator 7*a* and agitates the slurry in the first preparation tank for a predetermined time. Steps S1 to S5 define a primary preparation process.

At step S6, the concentration detector 8*a* detects the concentration of the aqueous hydrogen peroxide in the slurry. At step S7, the controller 16 compares the value of the detected concentration (detection value) with the target value. The preparation process ends when the detection value matches the target value.

When the detection value is less than the predetermined value (YES) in step S7, the controller 16 proceeds to step S8 and calculates the amount of the aqueous hydrogen peroxide that should be added from the difference between the detection value and the target value. At step S9, the controller activates the second stock solution pump P2, opens the stock solution valve 5*a*, and adds the calculated additional amount of the aqueous hydrogen peroxide in the first preparation tank 1.

At step S10, the agitator 7*a* agitates the slurry in the first preparation tank 1 for a predetermined time. The controller 16 then returns to step S6.

Steps S6 to S10 are repeated until the detection value matches the target value. Steps S6 to S10 define a secondary preparation process. The secondary preparation process ends when the detection value matches the target value.

When slurry is prepared in the second preparation tank 2, steps S1 to S10 are performed in the same manner.

Figure 5:
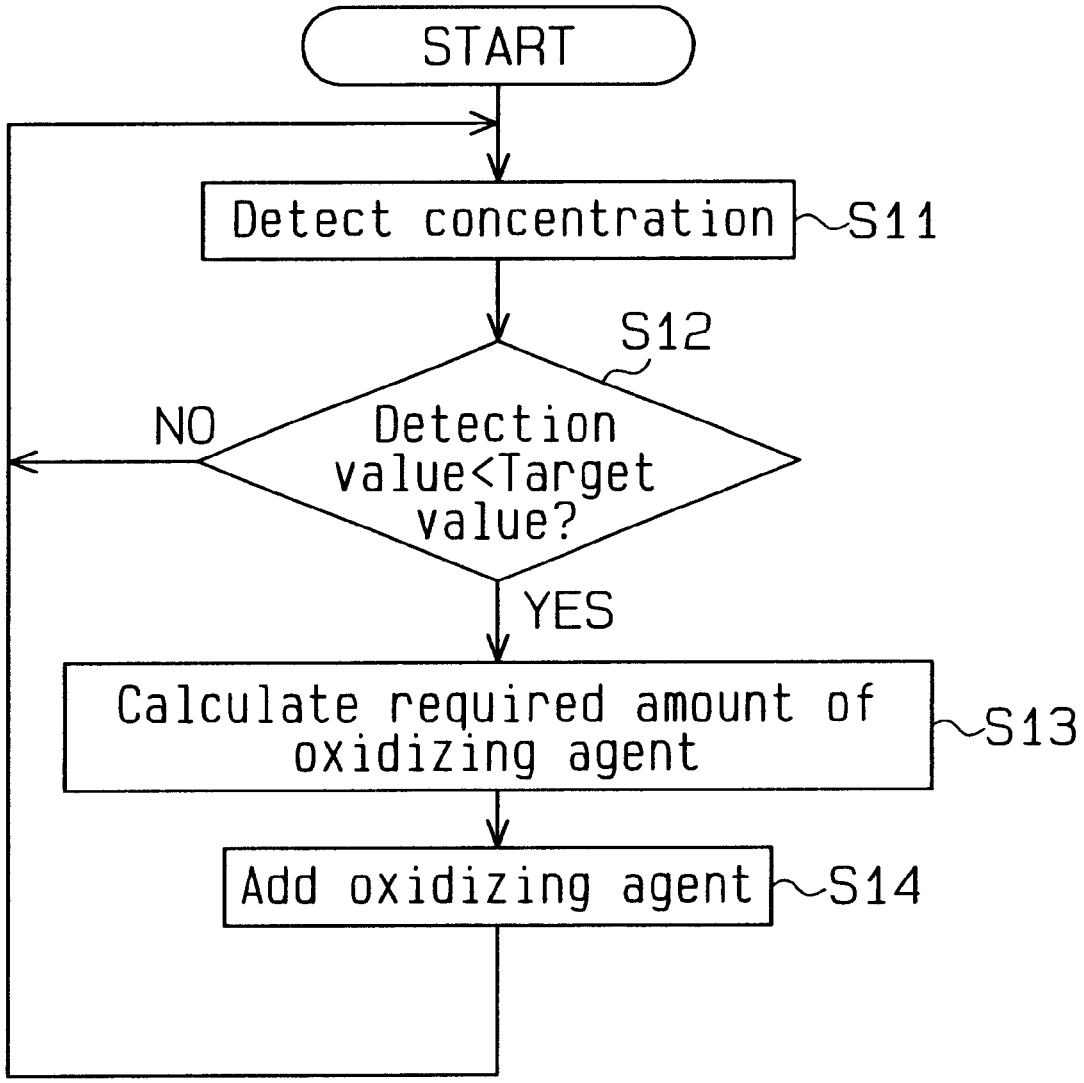
FIG. 5 is a flows chart illustrating the operation of the concentration control unit.

When slurry is being fed to the CMP device 10 from the first preparation tank 1 or the second preparation tank 2, the concentration control unit 6 maintains the concentration of the oxidizing agent in the slurry at a constant value in accordance with the flowchart of FIG. 5.

For example, when the first preparation tank 1 feeds slurry to the CMP device 10, at steps S11 and S12, the concentration control unit 6 constantly monitors the detection signal of the concentration detector 8*a*. When the value of the detected concentration (detection value) becomes less than the target value (YES in step S12), at step S13, the concentration control unit 6 calculates the amount of the aqueous hydrogen peroxide that is required to be added from the difference between the detection value of the concentration control unit 6 and the target value and from the remaining amount of the slurry in the first preparation tank 1. At step S14, the concentration control unit 6 activates the second stock solution pump P2 and opens the stock solution valve 5*a* to add the required amount of aqueous hydrogen peroxide to the first preparation tank 1. The first preparation tank 1 continues to feed slurry to the CMP device 10 while the concentration control unit 6 repeats steps S11 to S14 until the detection value matches the target value.

Figure 7:
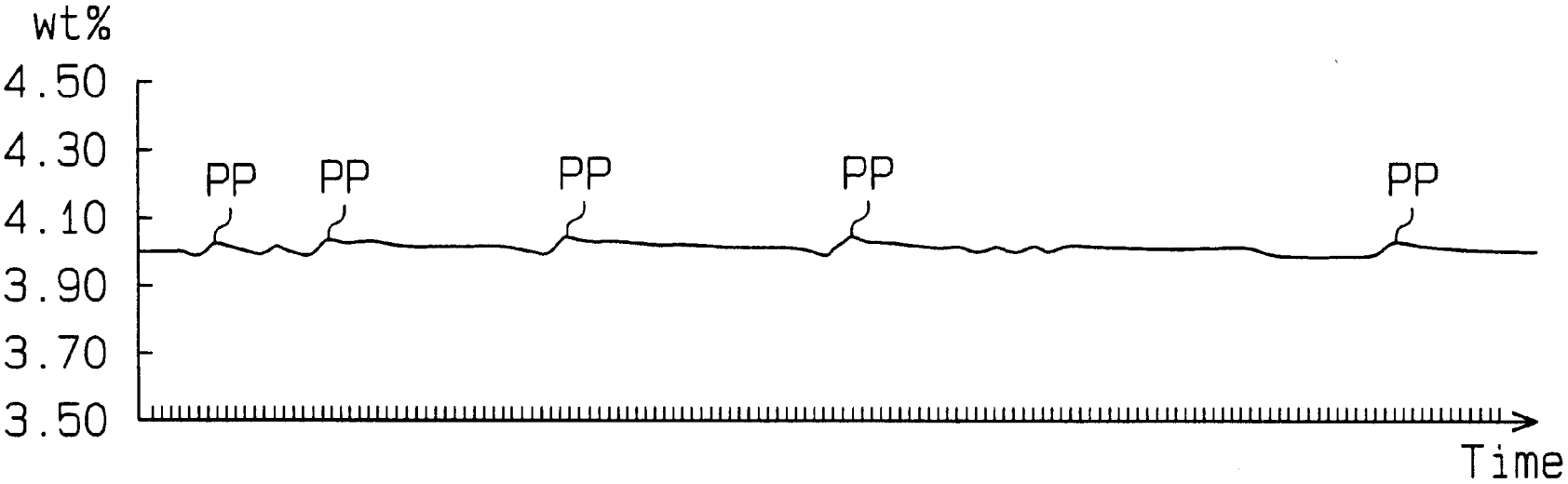
FIG. 7 is a graph illustrating the concentration of an oxidizing agent when slurry is fed.
Figure 9:
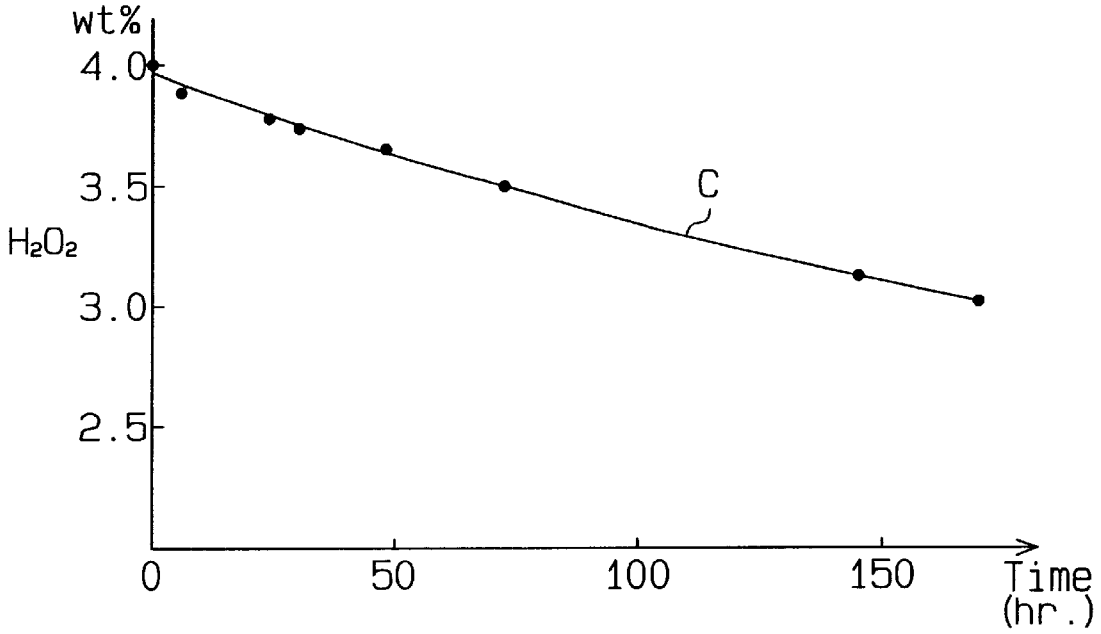
FIG. 9 is a graph illustrating changes in the concentration of aqueous hydrogen peroxide that is included in the slurry.

As shown in FIG. 9, the concentration of the aqueous hydrogen peroxide in the slurry gradually decreases as time elapses due to chemical reactions. However, the concentration of the aqueous hydrogen peroxide in the slurry is constantly monitored when slurry is being fed through the processes illustrated in the flowcharts of FIGS. 4 and 5. Accordingly, aqueous hydrogen peroxide is replenished at each replenishing point as shown in FIG. 7. This maintains the concentration of the aqueous hydrogen peroxide in the slurry at the target value.

The slurry feeding apparatus 100 of the first embodiment has the advantages described below.

(1) Each of the preparation tanks 1, 2 perform the preparation of slurry and the feeding of slurry to the CMP device 10 alternately. Thus, the CMP device 10 is constantly fed with fresh slurry. As a result, the grinding rate is maintained at a constant value.

(2) When slurry is prepared in the preparation tanks 1, 2, the concentration detectors 8*a*, 8*b* constantly detect the concentration of the prepared slurry, and the concentration control unit 6 constantly compares the detection values of the concentration detectors 8*a*, 8*b* with the target value. The aqueous hydrogen peroxide is properly replenished based on the comparison result. Thus, the aqueous hydrogen peroxide concentration is maintained at the target value. Accordingly, slurry having the predetermined aqueous hydrogen peroxide concentration is constantly prepared.

(3) When the primary preparation of slurry is performed in the preparation tanks 1, 2, the amount of aqueous hydrogen peroxide is such that the concentration of the aqueous hydrogen peroxide is less than the target value. Thus, even if the concentration of the aqueous hydrogen peroxide is not uniform in the second stock solution tank 4, the concentration of the aqueous hydrogen peroxide in the slurry during the primary preparation does not exceed the target value. Accordingly, during the secondary preparation that follows the primary preparation, the concentration of the aqueous hydrogen peroxide is adjusted just by adding aqueous hydrogen peroxide in accordance with the detected concentration. Accordingly, the concentration is readily and easily controlled.

(4) When the preparation tanks 1, 2 feed slurry to the CMP device 10, the concentration detectors 8*a*, 8*b* constantly monitor the aqueous hydrogen peroxide concentration of the slurry. When the concentration becomes insufficient, aqueous hydrogen peroxide is immediately added. Accordingly, the CMP device 10 is fed with slurry having an aqueous hydrogen peroxide concentration that is maintained at a constant value.

Figure 8:
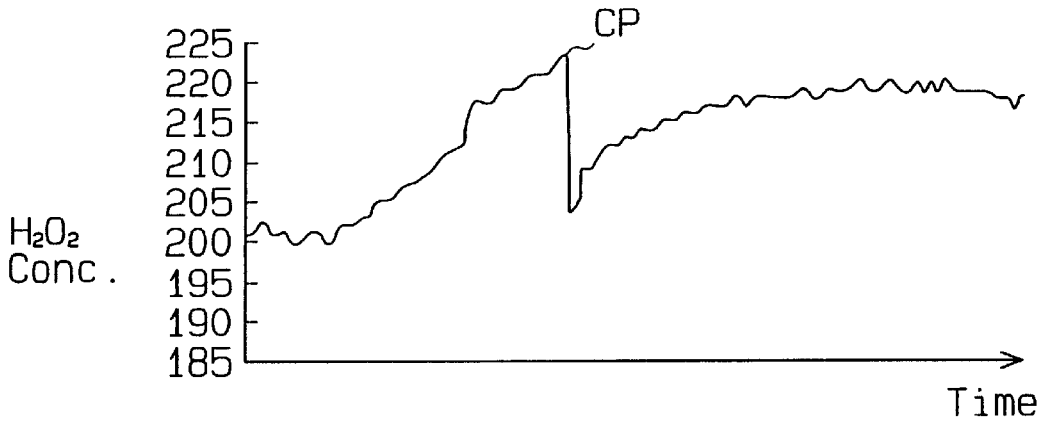
FIG. 8 is a graph illustrating fluctuation in the detection of the concentration detector that is caused by bubbles.

(5) The concentration detectors 8*a*, 8*b* are arranged immediately downstream to the associated preparation tanks 1, 2. Slurry forcefully flows upward through the concentration detectors 8*a*, 8*b*. Accordingly, the slurry flowing through the concentration detectors 8*a*, 8*b* prevents bubbles from collecting at the detection and reflection portions 11, 12 of the concentration detectors 8*a*, 8*b*. This enables accurate concentration detection. If bubbles were to collect at the detection and reflection portions 11, 12, the detected concentration would significantly fluctuate when the bubbles are suddenly removed as shown in FIG. 8 at detection point CP. This would lower the reliability of the detection value. However, in the first embodiment, the bubbles are prevented from collecting at the detection and reflection portions 11, 12. Thus, the concentration is accurately detected.

Figure 6:
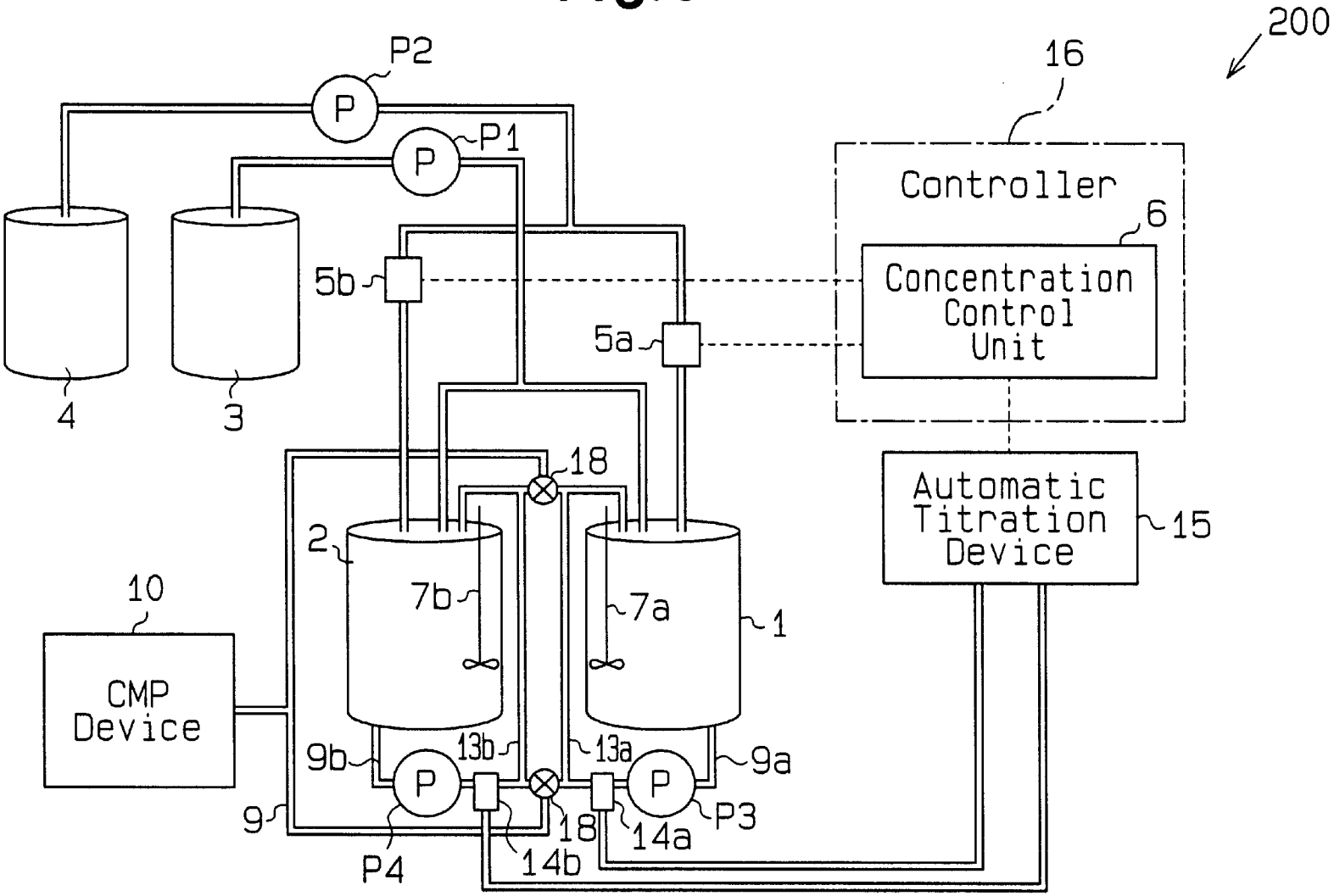
FIG. 6 is a schematic diagram showing a chemical solution feeding apparatus according to a second embodiment of the present invention.

A slurry feeding apparatus 200 according to a second embodiment of the present invention is shown in FIG. 6. In the second embodiment, an automatic titration device 15 is used in lieu of the concentration detectors 8*a*, 8*b* of the first embodiment. Otherwise, the structure of the second embodiment is the same as the structure of the first embodiment.

The slurry forced out of the slurry pumps P3, P4 is sent to the circulation pipes 13*a*, 13*b* or the main pipe 9 through extraction valves 14*a*, 14*b*.

When each of the preparation tanks 1, 2 prepares slurry or feeds slurry to the CMP device 10, some of the slurry forced out of the slurry pumps P3, P4 is constantly sent to the automatic titration device 15 through the extraction valves 14*a*, 14*b*.

The automatic titration device 15 performs neutralization titration to automatically detect the aqueous hydrogen peroxide concentration of the slurry, which it receives. Then, the automatic titration device 15 sends the detection value to the concentration control unit 6.

The concentration control unit 6 operates in the same manner as the first embodiment based on the detection value of the automatic titration device 15.

In the slurry feeding apparatus 200 of the second embodiment, the detection speed of the automatic titration device 15 is slower that that of the concentration detectors 8*a*, 8*b* of the first embodiment. Thus, the response of concentration adjustment when slurry is being fed is inferior to that of the first embodiment. However, during the preparation of slurry, the automatic titration device 15 is sufficient for detecting the aqueous hydrogen peroxide concentration of the slurry to add the lacking amount of aqueous hydrogen peroxide.

It should be apparent to those skilled in the art that the present invention may be embodied in many other specific forms without departing from the spirit or scope of the invention. Particularly, it should be understood that the present invention may be embodied in the following forms.

The oxidizing agent is not limited to aqueous hydrogen peroxide.

The number of preparation tanks is not limited to two and may be any number.

A measuring cylinder may be used to manually measure the oxidizing agent that is supplied to the preparation tanks 1, 2.

A gravimeter may be used to measure the oxidizing agent that is supplied to the preparation tanks 1, 2.

The present examples and embodiments are to be considered as illustrative and not restrictive, and the invention is not to be limited to the details given herein, but may be modified within the scope and equivalence of the appended claims.

What is claimed is:

1. An apparatus for feeding a chemical solution to an external device, the apparatus comprising:

a preparation tank supplied with a first stock solution and a second stock solution to mix the first and second stock solutions and prepare the chemical solution;

a circulation pipe connected to the preparation tank to circulate the chemical solution that is being prepared;

a feeding pipe connected between the preparation tank and the external device to feed the external device with the chemical solution contained in the preparation tank;

a pump for sending the chemical solution in the preparation tank to the circulation pipe and the feeding pipe;

an ultrasonic concentration detector arranged downstream to the pump to detect the concentration of the chemical solution; and a controller for controlling the concentration of the chemical solution in the preparation tank in accordance with a detection value of the concentration detector and for controlling the feeding of the chemical solution.

2. The apparatus according to claim 1, wherein the concentration detector is arranged so that the chemical solution flows upward through the concentration detector.

3. The apparatus according to claim 1, wherein the first stock solution is a slurry stock solution, the second stock solution is an oxidizing agent, the chemical solution is slurry formed from a mixture of the slurry stock solution and the oxidizing agent, and the ultrasonic concentration detector continuously detects the concentration of the oxidizing agent in the slurry.

4. The apparatus according to claim 3, wherein the oxidizing agent is aqueous hydrogen peroxide.

5. The apparatus according to claim 3, wherein the preparation tank is one of a plurality of preparation tanks that includes a first preparation tank and a second preparation tank, wherein the controller alternately performs the preparation of the slurry and the feeding of the slurry in each of the first and second preparation tanks, and the controller controls the first and second preparation tanks so that one of the preparation tanks performs the preparation of the slurry while the other one of the preparation tanks performs the feeding of the slurry, the controller adjusting the concentration of the oxidizing agent in the slurry in accordance with the detection value when the slurry is being prepared and when the slurry is being fed to the external device.

6. The apparatus according to claim 5, wherein the controller includes a concentration control unit for adjusting the concentration of the oxidizing agent in the slurry and for controlling the supplied amount of the oxidizing agent in accordance with the detection value of the ultrasonic concentration detector.

7. The apparatus according to claim 6, wherein the concentration control unit calculates a difference between the detection value of the concentration detector and a predetermined target value and calculates an additionally required amount of the oxidizing agent based on the amount of slurry in the preparation tank and the difference.

8. The apparatus according to claim 7, wherein, when preparing the slurry, the concentration control unit performs primary preparation, in which the oxidizing agent is supplied so that the concentration of the oxidizing agent in the slurry is less than the target value, and secondary preparation, in which the oxidizing agent is additionally supplied so that the detection value matches the target value.

9. An apparatus for feeding an external device with slurry formed from a mixture of slurry stock solution and aqueous hydrogen peroxide, the apparatus comprising:

a first stock solution tank containing the slurry stock solution;

a second stock solution tank containing the aqueous hydrogen peroxide;

a preparation tank supplied with the slurry stock solution and the aqueous hydrogen peroxide from the first and second stock solution tanks to prepare the slurry;

an agitator for mixing the slurry stock solution and the aqueous hydrogen peroxide in the preparation tank;

a feeding pipe connected between the preparation tank and the external device to feed the slurry from the preparation tank to the external device;

a pump arranged in the feeding pipe to send the slurry through the feeding pipe;

a circulation pipe connected between the feeding pipe and the preparation tank downstream to the pump to circulate the slurry in the preparation tank;

an ultrasonic concentration detector for continuously detecting the concentration of the aqueous hydrogen peroxide in the slurry, wherein the concentration detector is arranged between the pump and the circulation pipe so that the slurry flows upward through the concentration detector; and a controller for maintaining the concentration of the aqueous hydrogen peroxide of the slurry in the preparation tank at a predetermined target value and for controlling the feeding of the slurry to the external device.

10. The apparatus according to claim 9, wherein the preparation tank is one of a plurality of preparation tanks that includes a first preparation tank and a second preparation tank, wherein the controller alternately performs the preparation of the slurry and the feeding of the slurry in each of the first and second preparation tanks, and the controller controls the first and second preparation tanks so that one of the preparation tanks performs the preparation of the slurry while the other one of the preparation tanks performs the feeding of the slurry, the controller additionally supplying the aqueous hydrogen peroxide so that the concentration of the aqueous hydrogen peroxide in the slurry is maintained at the target value when the slurry is being prepared and when the slurry is being fed to the external device.

* * * * *